US005947381A

United States Patent [19]

Carey

[11] Patent Number: 5,947,381

[45] **Date of Patent: *Sep. 7, 1999**

[54] REVERSIBLE SPRAY TIP

[75] Inventor: Danuta H. Carey, Stockholm, N.J.

[73] Assignee: Wagner Titan Inc., Minneapolis, Minn.

[ * ] Notice: This patent is subject to a terminal disclaimer.

[21] Appl. No.: 08/962,037

[22] Filed: Oct. 31, 1997

Related U.S. Application Data

[63] Continuation-in-part of application No. 08/578,864, Dec. 27, 1995, Pat. No. 5,749,528.

[51] Int. Cl.[6] ..... B05B 15/02

[52] U.S. Cl. ..... 239/119; 239/288; 239/288.3; 239/600

[58] Field of Search ..... 239/119, 288, 239/288.3, 600

[56] References Cited

U.S. PATENT DOCUMENTS

| | | | |
|---|---|---|---|
| 3,202,360 | 8/1965 | O'Brien . | |
| 3,428,340 | 2/1969 | Pelton . | |
| 4,165,836 | 8/1979 | Eull . | |
| 4,508,268 | 4/1985 | Geberth, Jr. . | |
| 4,611,758 | 9/1986 | Geberth, Jr. . | |
| 4,715,537 | 12/1987 | Calder . | |
| 4,757,947 | 7/1988 | Calder . | |
| 4,830,281 | 5/1989 | Calder | 239/119 |
| 5,280,853 | 1/1994 | Perret, Jr. . | |
| 5,294,053 | 3/1994 | Perret, Jr. . | |
| 5,340,029 | 8/1994 | Adams . | |
| 5,379,938 | 1/1995 | Perret, Jr. | 239/119 |
| 5,765,753 | 6/1998 | Kieffer | 239/600 X |

*Primary Examiner*—Andres Kashnikow
*Assistant Examiner*—Robin O. Evans
*Attorney, Agent, or Firm*—Faegre & Benson LLP

[57] ABSTRACT

A spray tip housing includes a turret member having a stem portion and a handle, an axial passageway having an outlet and an inlet, and a seal insert operatively disposed in the axial passageway. The handle is configured to enter the outlet of the axial passageway to push the seal insert at least partially through the axial passageway. The axial passageway has a rectangular cross section and the handle is tapered and includes a rectangular cross section that is sized to enter the axial passageway. The turret member is movable between a spraying position and a cleaning position, and the handle is made of soft plastic and includes direction indicia for indicating the position of the turret member. The direction indicia includes an arrow-shaped portion for pushing the seal from the axial passageway.

14 Claims, 7 Drawing Sheets

REVERSIBLE SPRAY TIP

This is a continuation-in-part of U.S. patent application Ser. No. 08/578,864, filed Dec. 27, 1995, now U.S. Pat. No. 5,749,528, the entire disclosure of which is incorporated herein by reference.

BACKGROUND OF THE INVENTION

The present invention relates generally to spray tips or nozzles for use in spray guns which are adapted to hydraulically atomize and spray liquids such as paint, and particularly to such spray tips or nozzles wherein the spray tip is reversible so that obstructions therein which clog the nozzle may be easily removed by the reversed flow of the high pressure liquid therethrough. More particularly, the invention relates to such nozzles that can be disassembled without tools.

An inherent disadvantage in hydraulic or airless spray painting, wherein paint under high pressure is supplied to a spray gun and forced through a spray tip or nozzle, is clogging. Because of the nature of this method of paint spraying, it is necessary that the spray opening in the spray tip be very small so that as the paint reaches the spray tip under high pressure and low velocity, it is accelerated through the spray opening to a high velocity and low pressure thereby forming a fan spray suitable for painting. Because of the small size of the spray opening, the spray is susceptible to clogging with particles carried in the fluid paint.

One simple method of unclogging hydraulic spray tips is to provide a spray tip which is reversible so that the flow therethrough can be reversed to thereby dislodge the particles causing the clog. Examples of hydraulic spray tips incorporating such reversibility can be found in U.S. Pat. No. 4,508,268, to Geberth, Jr., granted Apr. 2, 1985; U.S. Pat. No. 3,202,360, to O'Brien, granted Aug. 24, 1965; U.S. Pat. No. 4,165,836, to Eull, granted Aug. 28, 1979; U.S. Pat. No. 4,715,537, to Calder, granted Dec. 29, 1987; and U.S. Pat. No. 4,830,281 to Calder, granted May 16, 1989.

In each of these prior art patents, the spray tip is mounted in a diametric passageway in a transverse cylinder which is adapted for axial rotation so as to present the spray tip forwardly for spraying or rearwardly so that the spray tip faces the high pressure liquid. In the latter position, the high pressure liquid passing through the spray tip in the reversed direction dislodges and removes any clogging matter therein. The transverse, axially rotatable cylinder is supported in a transverse passageway of a housing which has a flange at its end facing the discharge end of the spray gun, which flange is engaged by a securing nut which secures the assembly to the forward end of the spray gun. Sealing members are also provided to prevent leakage during operation of the spray tip.

A major problem inherent in such reversible spray tips is preventing leakage between the axially rotatable cylindrical member and the fluid passageway passing through the housing delivering the high pressure fluid paint to the spray opening of the spray tip. The usual construction of such reversible spray tips includes an insert axially arranged in an axial passageway of the housing and which is provided with a fluid passageway passing therethrough. This insert performs the sealing function and is formed of a generally soft material such as plastic with a flange at the end facing the spray gun which is compressed between the flange of the housing and the discharge end of the spray gun. The end of the insert facing the rotatable cylinder may be formed of plastic material as in U.S. Pat. No. 4,508,268 or it may be provided with a hard material at this face as disclosed in U.S. Pat. No. 4,611,758, to Geberth, Jr., granted Sep. 16, 1986. In either event, sealing pressure is provided by the securing nut which must be tightened significantly.

Another problem occurs after spraying with the nozzle, when it is desirable to disassemble the nozzle for cleaning. The seal insert may become lodged in the axial passageway of the housing, and the insert is sometimes difficult to remove, requiring the use of a tool to eject the seal insert. U.S. Pat. No. 4,830,281 sizes a turret member for use as an ejector pin to remove a seal insert. However, the turret member is a finely machined part, and using the turret member to eject the seal insert can scratch or mar the machined surface or damage the seal insert, either of which can adversely affect the sealing function between the seal insert and the turret member during spraying operations. Moreover, a preferred axial passageway for receiving the seal insert is rectangular to ensure proper alignment of the seal insert. However, a rectangular passageway poses an additional problem in that a cylindrical turret member does not match a rectangular opening.

Moreover, if the cylindrical turret member is used to dislodge the seal from the housing, paint may drip from the guards onto the cylindrical turret portion. This is a problem in that the turret member should be kept clean in order to provide a smooth seal against the insert.

SUMMARY OF THE INVENTION

The present invention overcomes to a great extent the disadvantages of the prior art by providing a nozzle that can be readily disassembled without tools and without damage to the spray tip holder.

In a preferred embodiment of the invention, a spray nozzle includes a spray tip housing, a turret member, and a seal insert. The housing has a first transverse passageway and an axial passageway, and the seal insert has a second transverse passageway and is operatively disposed in the axial passageway of the housing. The turret member includes a cap member and a stem portion. The stem portion is operatively disposed in the transverse bores and is removable from the housing. The cap member is sized and configured to facilitate removal of the seal insert from the axial passageway during disassembly of the spray nozzle.

According to one aspect of the invention, the axial passageway through the housing has a rectangular cross section and the cap member includes a rectangular cross section that is smaller than the axial passageway cross section.

According to another aspect of the invention, the turret member is movable in the first and second transverse bores between a spraying position and a cleaning position and includes direction indicia to indicate the position of the turret member.

The present invention also relates to a method of disassembling a nozzle. A preferred method includes the steps of providing a nozzle housing having an axial passageway and a transverse passageway, a seal insert operatively disposed in the axial passageway, and a turret member having a stem portion and a cap member; removing the turret member from the transverse passageway; aligning the cap member with the seal insert; and pushing against the seal insert with the cap member to eject the seal insert from the housing. In the preferred method, the cross section of the cap member is smaller than the cross section of the axial passageway.

An object of the invention is to provide a nozzle that can be disassembled without tools. Another object of the invention is to provide disassembly without tools and without damaging the spray tip holder or the seal insert. Another object is to provide a method of disassembling a nozzle without the use of tools.

A further object of the invention is to provide a reversible spray tip for a spray gun or like device having an axially rotatable transverse cylindrical member with a spray tip arranged in a diametric passageway therein which is is of simpler construction and thus more easily manufactured than similar prior art spray tips and which is more effective in preventing leakage of the fluid paint.

A further object of the present invention is to provide a safe reversible spray tip in that the spray tip guard is an integral part of the spray tip and cannot be removed. A still further object of the invention is to provide such a reversible spray tip which has a positive snap lock feature to indicate positioning of the transverse cylindrical member in the forward spraying position or in the reverse flow position.

These and other objects, features and advantages of the invention will become apparent from the following detailed description of preferred embodiments of the present invention.

DETAILED DESCRIPTION OF PREFERRED EMBODIMENTS

Figure 1:
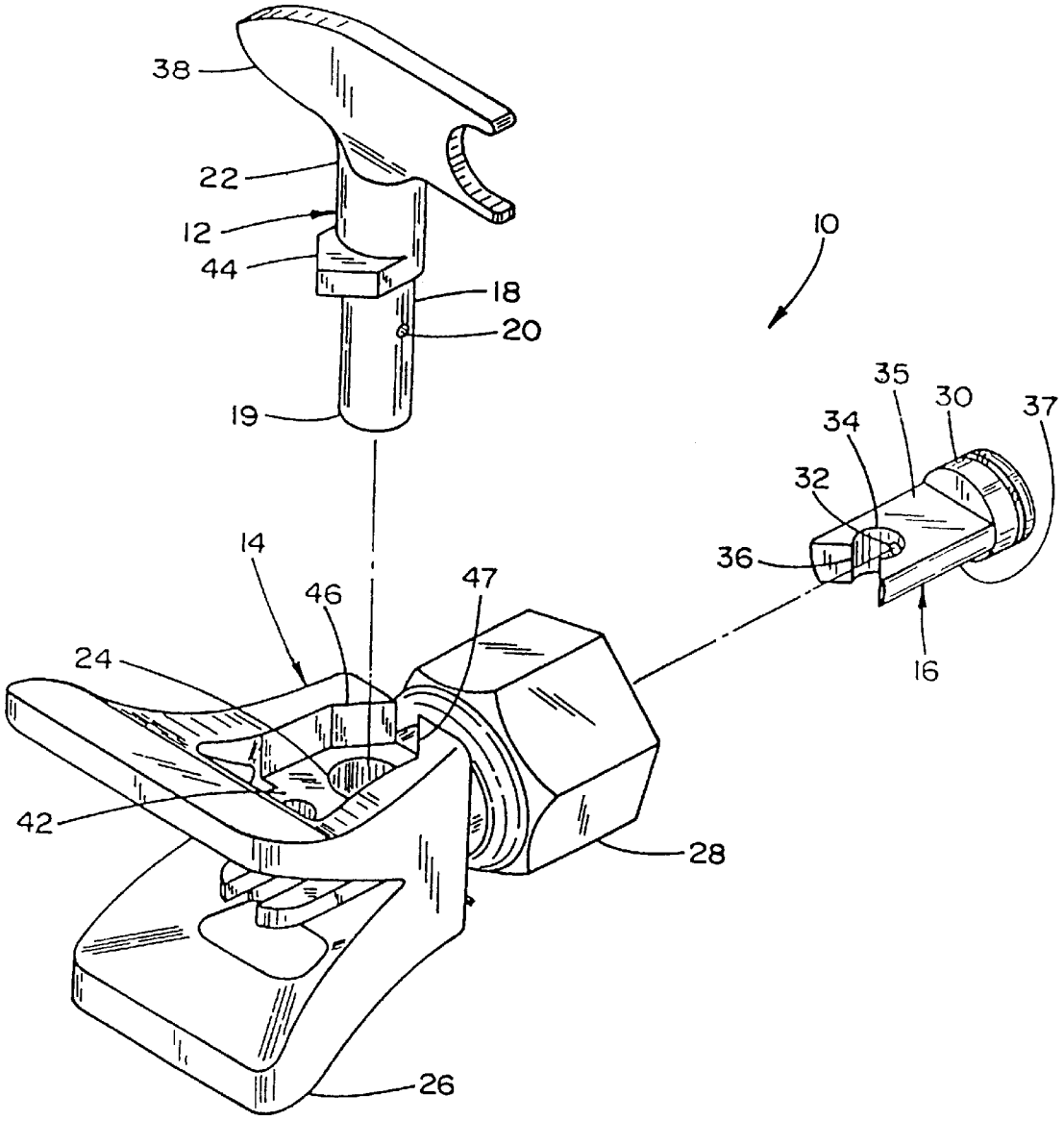
FIG. 1 is an exploded perspective view of a reversible spray tip unit constructed in accordance with one embodiment of the present invention.

Referring now to the drawings, where like elements are designated by like reference numerals, there is shown in FIG. 1 a reversible spray tip unit 10 for use with a spray gun or like device adapted to hydraulically atomize and spray liquids such as paint. Spray tip unit 10 includes a cylindrically shaped turret member 12, a spray tip housing 14, and a sealing member or seal insert 16.

Cylindrically shaped turret member 12 includes a stem portion 18 having a diametric passageway 20 therein and a cap member (or handle) 22 adapted to be gripped by the user's fingers to rotate turret member 12. Housing 14, preferably formed of plastic material, is provided with a transverse passageway 24 adapted to accept stem portion 18 of cylindrical turret member 12 therein, a through axial passageway 25 adapted to accept seal insert 16 therein, and Y or V shaped forward extending ears which form tip guard 26.

A securing nut, designated 28, rotatably mounted at the rear of housing 14, secures spray tip unit 10 to the forward or discharge end 29 (FIGS. 7 and 8) of the spray gun. Securing nut 28 cooperates with housing 14 and a flange 30, of seal insert 16 to cause seal insert 16 to seal against the end face of the spray gun. Seal insert 16 is provided with an axial fluid passageway 32 which aligns with the fluid passageway (not shown) of the spray gun at one end and with passageway 20 in stem portion 18 of cylindrical member 12 at the forward end. The forward end of seal insert 16 is provided with transverse passageway 34 which has a sidewall opening 36 at the forward end of the insert.

While seal insert 16 is generally cylindrical in shape, it is provided with at least one longitudinal flat 35 which is complementary to at least one identical flat in the through axial passageway 125 of housing 14 which accepts seal insert 16 therein. Longitudinal flat 35 and its complementary flat in the axial passageway 125 are so arranged to index seal insert 16 so that passageway 34 thereof aligns with transverse passageway 24 of housing 14. Thus, when stem portion 18 of turret member 12 is inserted into passageway 24 it is accepted without deviation into passageway 34 of seal insert 16 thereby facilitating the accurate assembly of reversible spray tip unit 10. An additional longitudinal flat 37 is provided on seal insert 16 which mates with a complementary identical flat in the through axial passageway of housing 14 thereby permitting seal insert 16 to be positioned in the axial passageway 125 in either of two positions disposed one hundred eighty degrees with respect to each other.

Figure 2:
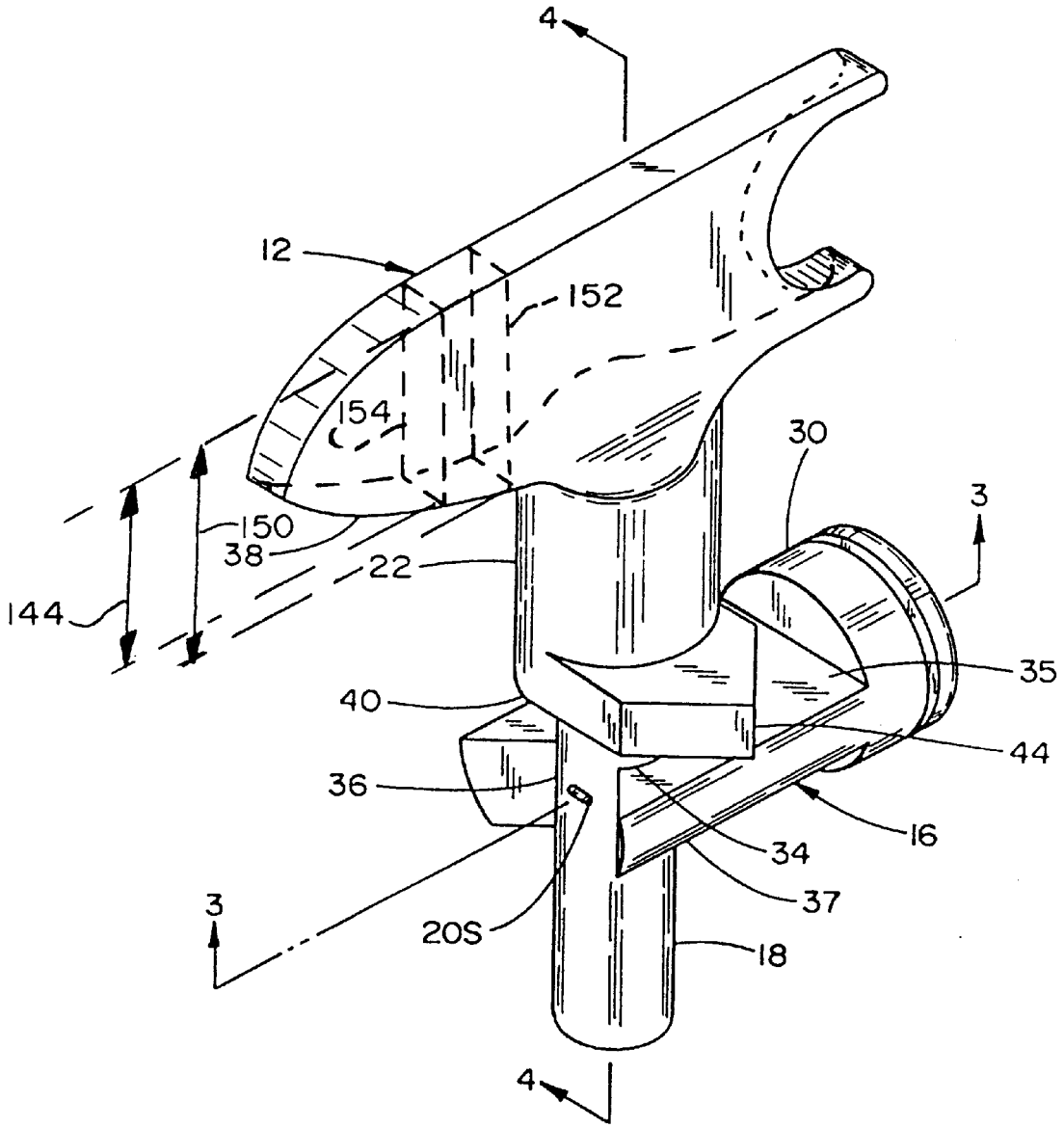
FIG. 2 is a perspective view of the reversible spray tip unit of FIG. 1 shown assembled but without the housing.

As clearly seen in FIG. 2, stem portion 18 of cylindrical turret member 12 is accepted within passageway 34 of seal insert 16 with an interference fit since passageway 34 has a slightly smaller radius than stem portion 18. Because sidewall opening 36 is less than one hundred eighty degrees of passageway 34, the interference fit of stem portion 18 in passageway 34 holds cylindrical member 12 in the assembled reversible spray tip 10 without the need for other retaining means. The bottom end 19 of stem portion 18 is tapered to facilitate the insertion of stem portion 18 into passageway 34 of seal insert 16.

Furthermore, since seal insert 16 is formed of a plastic material, the radial force exerted by stem portion 18 against the wall of passageway 34 enhances the sealing pressure of seal insert 16 at diametric passageway 20 in stem portion 18 and also exerts an axially directed pressure along seal insert 16 to enhance the sealing pressure against the front face of the spray gun. As also clearly shown in FIG. 2, the forward or spray end of passageway 20 in stem portion 18, designated 20S, has an elongated oval shape. The significance of this shape of forward end 20S of passageway 20 will be described hereinafter in connection with FIG. 9.

Cap member 22 of turret member 12 is fitted onto stem portion 18 such that the flattened arrow portion 38 thereof, which facilitates rotation of turret member 12 by the user, points in the direction of forward or spray end 20S of passageway 20. Thus, the user can easily determine whether the spray tip is in the spray position or in the reversed position for clearing a clogged spray opening by the position of arrow 38. The lower extremity of cap member 22 forms a shoulder 40 which, when spray tip 10 is assembled, rests on mating surface 42 of housing 14 such that diametric passageway 20 of stem portion 18 is substantially aligned with axial fluid passageway 32 of seal insert 16 when turret member 12 is positioned for spraying or reversed for clearing obstructions. Shoulder 40 has, extending radially therefrom, a locking cam element 44 which is substantially triangularly shaped and which cooperates with flat wall faces 46, 47 which extend upwardly from surface 42 of housing 14 to lock the position of turret member 12 in the spray position or in the reversed position as described hereinafter.

As clearly seen in FIGS. 3 to 6 and 9, a spray tip insert 48 formed of a hard material such as a tungsten carbide to resist erosion from the abrasive material passing through fluid passageway 50, is press-fitted into passageway 20 of stem portion 18 of turret member 12. The spray orifice 52 of insert 48 is positioned at forward end 20S of passageway 20 and a diffuser pin 54, also formed of tungsten carbide, is arranged diametrically in fluid passageway 50 upstream from orifice 52. Diffuser pin 54 ensures that when spray tip 10 is reversed for the purpose of dislodging material clogging spray orifice 52, the high pressure fluid exiting from fluid passageway 50 opposite orifice 52 does not do so as a solid stream.

A diffuser holder 49 is also press-fitted into passageway 20 behind diffuser pin 54 to maintain the pin 54 transversely in passageway 20. Preferably, the end of insert 48 opposite orifice 52 is provided with diametrically opposed recesses 51, 53 in which diffuser pin 54 nests or seats to thereby prevent movement of pin 54 as fluid passes. Diffuser holder 49 is machined to present a flush surface at stem portion 18. The passageway 55 of diffuser holder 49 at the surface of stem portion 18 is smaller than passageway 32 of seal insert 16 to thereby minimize scoring of the sealing face of seal insert 16 and to allow for slight misalignment of the axes of the bores 32, 55 and also to avoid sealing problems between the two bores.

Figure 3:
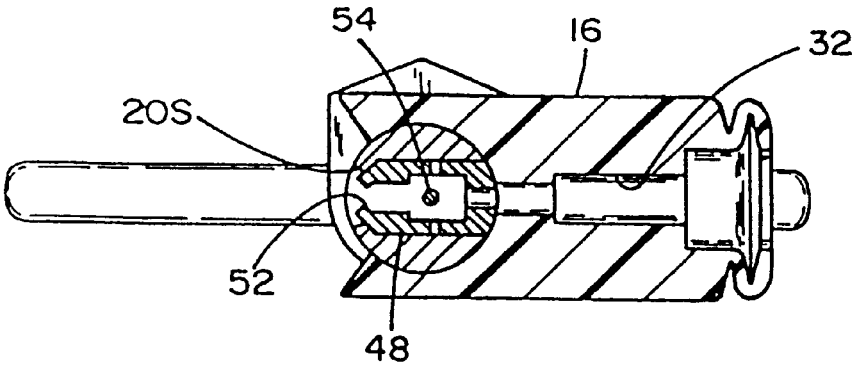
FIG. 3 is a cross-sectional view of the reversible spray tip unit of FIG. 1, shown in the spraying position taken along line 3—3 of FIG. 2.
Figure 4:
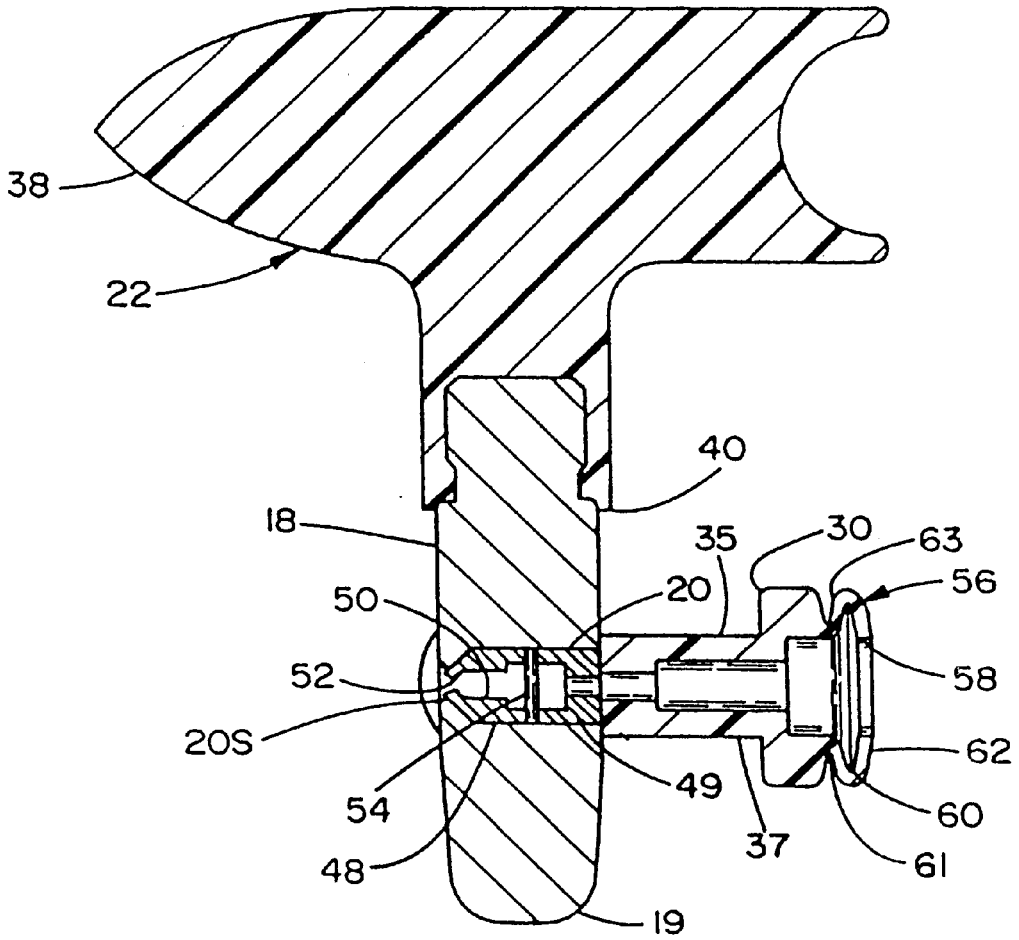
FIG. 4 is a cross-sectional view of the reversible spray tip unit of FIG. 1, shown in the spraying position taken along line 4—4 of FIG. 2.
Figure 5:
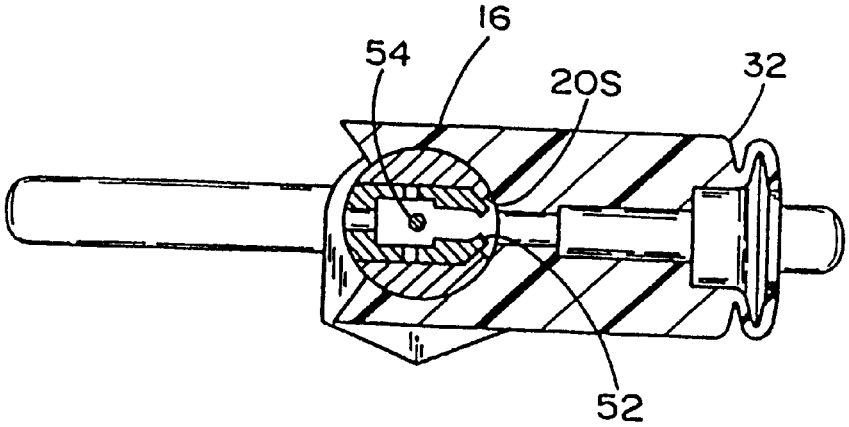
FIG. 5 is a cross-sectional view of the reversible spray tip unit of FIG. 3 shown in the reversed position.
Figure 6:
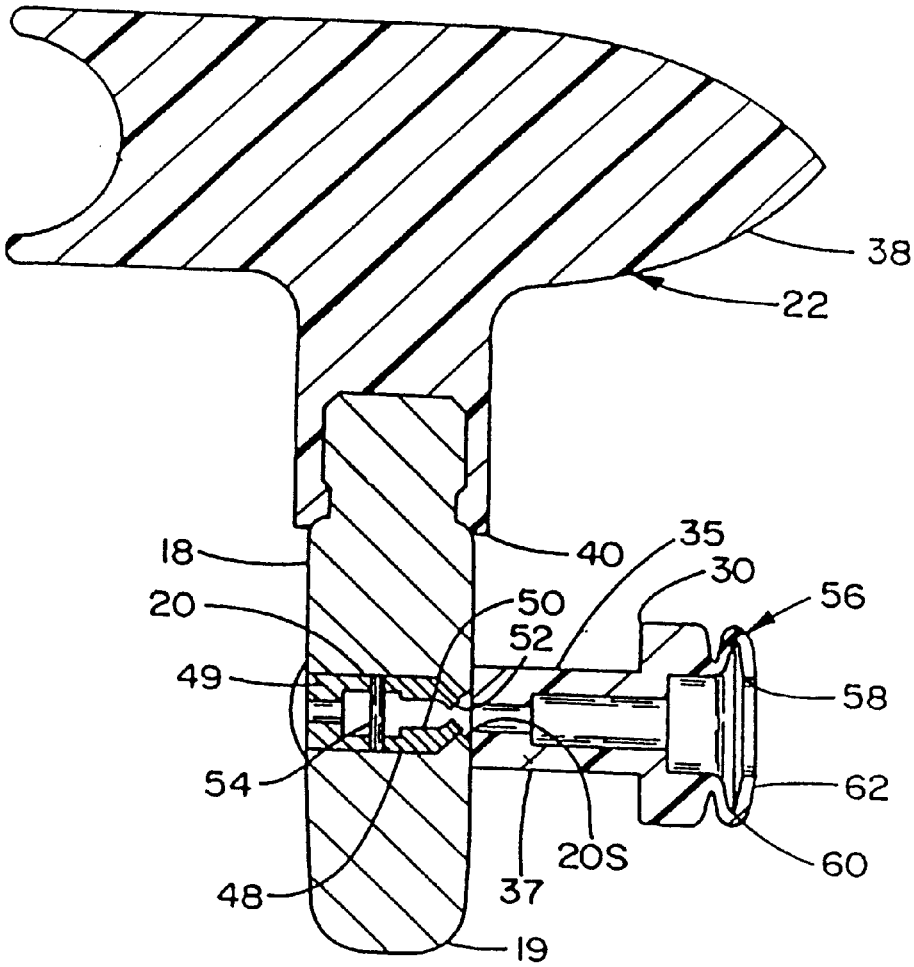
FIG. 6 is a cross-sectional view of the reversible spray tip unit of FIG. 4 shown in the reversed position.

FIGS. 3 and 4 show the positioning of the turret member 12 with respect to seal insert 16 with spray orifice 52 of spray tip insert 48 facing forwardly so that the high pressure fluid exiting therefrom forms a fan spray suitable for spray painting. FIGS. 5 and 6 show the position of turret member 12 with respect to seal insert 16 with spray orifice 52 of spray tip insert 48 facing rearwardly towards fluid passageway 32 of seal insert 16. In this latter described position, the high pressure fluid passing through fluid passageway 50 of spray tip insert 48 is reversed so that any material clogging spray orifice 52 is dislodged and driven out the larger opening of passageway 55 of diffuser holder 49 opposite orifice 52.

Flange 30 of seal insert 16 has axially extending therefrom a flexible seal member or washer 56 which faces the front face of the discharge end 29 of the spray gun to which spray tip unit 10 is attached. Seal member 56 has a fluid orifice 58 which communicates with the fluid passageway of the spray gun and an internal chamber 60 defined by flexible rear wall 62 which circumscribes orifice 58. As high pressure fluid enters chamber 60 of seal member 56, wall 62 thereof expands rearwardly against the front face of the discharge end 29 of the spray gun to create a seal thereat. Simultaneously, the pressure in chamber 60 forces seal insert 16 forwardly to enhance the sealing pressure between seal insert 16 and stem portion 18 of turret member 12.

An outer circumferential groove 61 may be formed forwardly of chamber 60 thereby defining a forward flexible wall 63 peripherally joined to rear wall 62. The forward wall 63 creates a bellows-like flexible seal member 56. Seal member 56 so enhances the sealing effectiveness of seal insert 16 during operation of the spray gun, that only finger tightening of securing nut 28 is required to produce a seal. Thus, when the spray gun is not operated and seal member 56 is in a relaxed state, the sealing pressure between seal insert 16 and turret member 12 is relieved to such an extent that the turret member 12 can be easily rotated from the spraying position shown in FIGS. 3 and 4 to the reversed cleaning position shown in FIGS. 5 and 6 without special tools.

Figure 7:
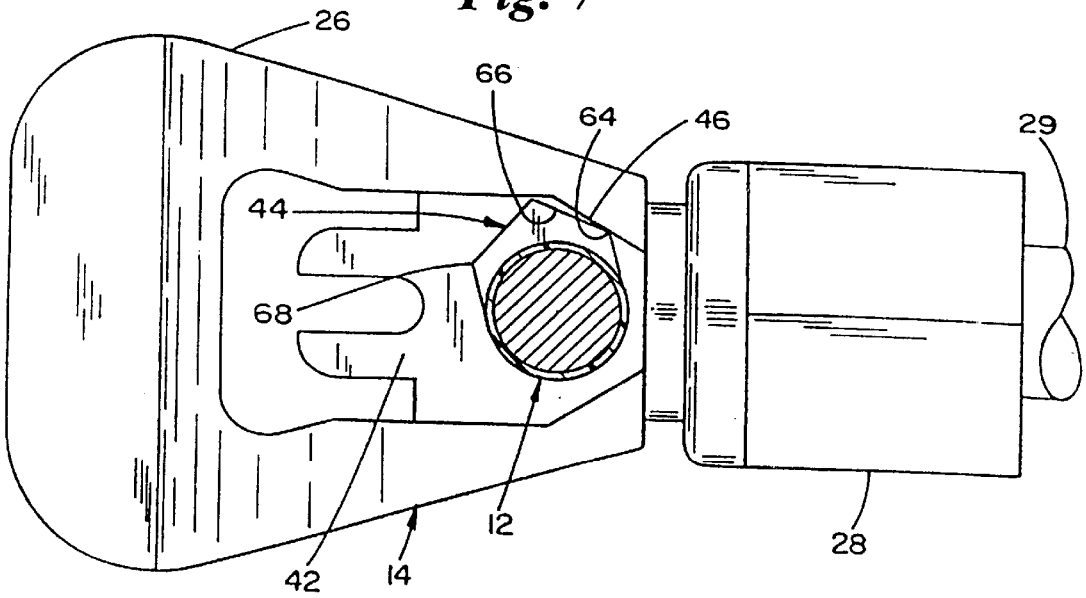
FIGS. 7 and 8 are plan views of the assembled reversible spray tip unit of FIG. 1 showing the locking feature for the rotatable cylindrical turret member.
Figure 8:
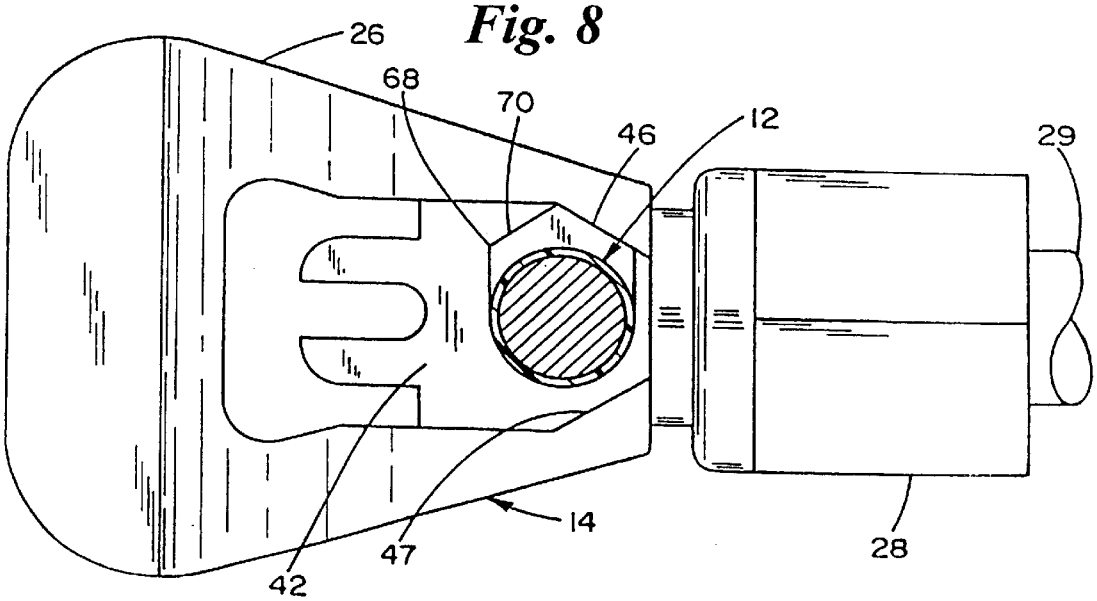

In FIGS. 7 and 8 the operation of locking cam element 44 is shown. Locking cam element 44 includes a first cam lobe 64 and adjoining flat surface 66 which mates with flat wall face 46 of housing 14. When cam lobe 64 passes wall face 46 and surface 66 of locking cam element 44 contacts and meets wall face 46 completing the clockwise rotation of turret member 12, as shown in FIG. 8, turret member 12 is in the reversed position permitting the clearing of the fluid passageway of spray tip insert 16. Locking cam element 44 also includes a second cam lobe 68 and adjoining flat surface 70 which is symmetrical with and a mirror image of cam lobe 64 and flat surface 66 and which cooperate with flat wall face 47 of housing 14 to lock-in or fix turret member 12 in the spraying position. Locking cam element 44 cooperating with wall faces 46 and 47 permit a positive locking-in of turret member 12 in the spraying position or the reversed position for cleaning.

Furthermore, the orientation of walls 46, 47, which are angularly arranged with respect to the longitudinal axis of reversible spray tip unit 10, helps to prevent paint build up thereon which may interfere with the proper operation of locking cam element 44. Paint build up on surfaces of the spray tip unit tends to be most severe on surfaces perpendicular to the longitudinal axis of the unit and least severe on surfaces parallel thereto since the general direction of paint over-spray or bounce back is axial with respect to the spray gun or spray tip unit.

Figure 9:
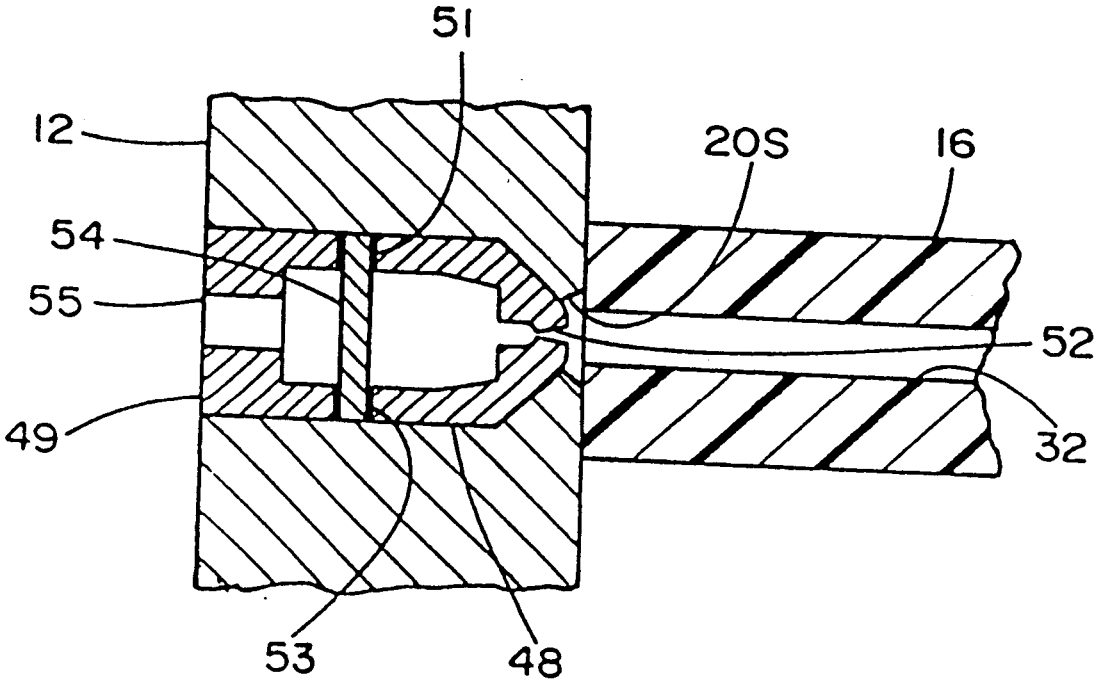
FIG. 9 is an enlargement of a portion of FIG. 6 showing the interface of the seal insert and the rotatable cylindrical turret member.

FIG. 9 is an enlarged view of rotatable turret member 12 in the reversed position for cleaning and the seal insert 16 of spray tip 10. As clearly seen therein, spray orifice 52 of spray tip insert 48 is positioned facing the high pressure fluid exiting fluid passageway 32 of seal insert 16. As indicated hereinabove, the forward end 20S of passageway 20 which receives spray tip insert 48 has an elongated oval shape which is substantially parallel to the conventional elongated slit of spray orifice 52 of spray tip insert 48. It is preferable that the outer edge of end 20S of passageway 20 not have a sharp corner in order not to score the plastic material at the face of seal insert 16 during the rotation of turret member 12. Thus, this outer edge can be rounded off during manufacture or machined to have an angle greater than zero degrees to the horizontal.

The elongated oval shape of end 20S of passageway 20, as opposed to the conventional round shape, exposes less surface area of spray tip insert 48 surrounding spray orifice 52 and turret member 12 to the pressure of the high pressure fluid exiting fluid passageway 32 of seal insert 16. As a result of this lower pressure exerted on spray tip insert 48 and turret member 12, less sealing pressure is required between turret member 12 and seal insert 16 to prevent leakage thereat so that over tightening of securing nut 28 is not required and mere finger tightening thereof suffices.

Seal insert 16 is formed of a plastic material which is chemically resistant, solvent resistant and high pressure resistant. Preferably, insert 16 is molded from a blend of NYLON Type 66, available from DuPont under the name ZYTEL 101 NYLON, and ZYTEL 801 NYLON also available from DuPont. Although proportions of these materials may be varied as desired, it has been found preferable to blend about 90% of ZYTEL 101 and 10% of ZYTEL 801 for purposes of the present invention.

In order to facilitate the disassembly of reversible spray tip unit 10, it has been found that once turret member 12 has been removed from the unit by extracting stem portion 18 from passageway 34 of seal insert 16, the flattened arrow portion 38 of cap member 22 (FIG. 1) can be advantageously utilized as an extraction tool to remove seal insert 16 from housing 14. Arrow portion 38 can be inserted into the open front of unit 10 to engage the forward end of seal insert 16 at about sidewall opening 36, as illustrated in FIG. 10, and, with axial pressure thereon, seal insert 16 can be dislodged from housing 14.

Figure 10:
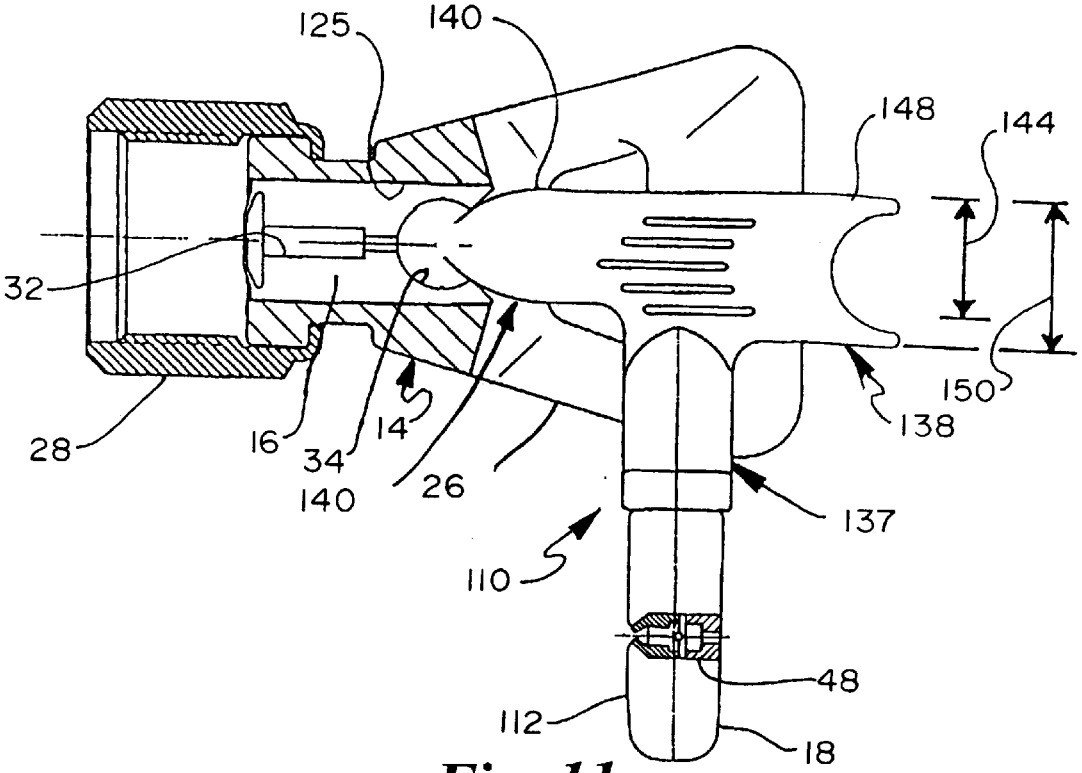
FIG. 10 is horizontal section view of another spray tip unit constructed in accordance with the present invention, taken along a horizontal plane through the center of the axial passageway of the spray tip showing the cap member in position to engage the seal insert.
Figure 11:
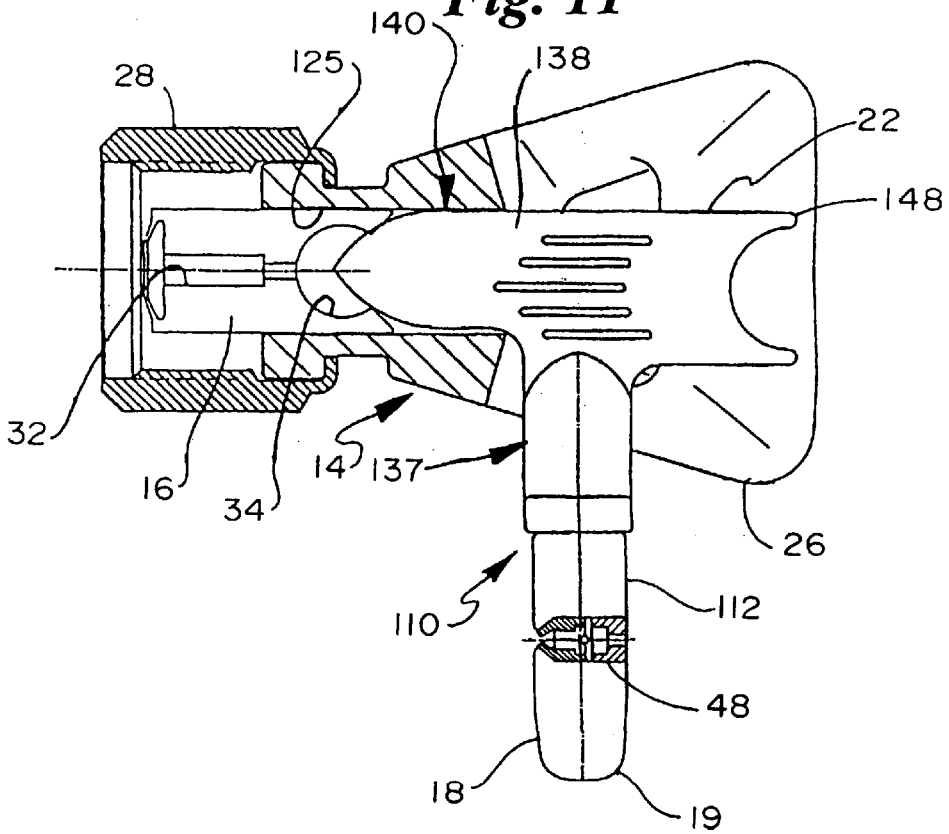
FIG. 11 is a view similar to FIG. 10 showing the cap member pushing the seal insert out of the axial passageway.

In a preferred embodiment, as illustrated in FIGS. 10-11, a spray tip 110 includes a cylindrical turret member 112 and a handle 137. The handle 137 includes an arrow portion 138 that is dimensioned to fit into the axial passageway 125 so that, as the arrow portion 138 enters the axial passageway 125, as illustrated in FIG. 11, the seal insert 16 is pushed out of the axial passageway 125. The arrow portion 138 includes a first portion 140 having a height dimension 144 that does not exceed the width of the axial passageway 125, and a second portion 148 having a height dimension 150 that is larger than height dimension 144. Advantageously, the arrow shaped portion 138 has a first rectangular cross section 152 and a second, smaller cross section 154, with the second cross section sized to fit in the axial passageway 125 of housing 14. This allows the first portion 140 to enter farther into the axial passageway 125 than the arrow portion 38 of the embodiment of FIGS. 1–9 in order to push the seal insert 16 out of the passageway 125. The second portion 148 provides a larger gripping area for turning the spray tip 110 in the aligned transverse bores 24 and 36 in the housing and seal insert, respectively.

In particular, preferred axial passageway 125 is rectangular and arrow portion 138 includes a rectangular cross section. This is especially advantageous because it allows the arrow portion 138 to enter the axial passageway 125 to eject the seal insert 16 while retaining the direction-indicating feature and keeping paint from dripping from the guard 26 onto the turret member 112. Moreover, it makes it unnecessary to use the turret member 112 as an ejector, thereby preventing damage to the turret member 112, and further eliminates the need for an additional tool, such as a screwdriver, to eject the seal insert 16. Another advantage is that the arrow portion 138 can be easily molded from soft plastic which prevents damage to the seal insert 16 and the axial passageway 125.

The above description and drawings are only illustrative of preferred embodiments of the present invention, and are not intended to limit the present invention. Any modification which comes within the spirit and scope of the following claims is to be considered part of the invention.

What is new and desired to be protected by Letters Patent of the United States is:

1. A spray nozzle comprising: a turret member having a stem portion and a handle, an axial passageway having an outlet and an inlet, and a seal insert operatively disposed in the axial passageway, the handle being configured to enter the outlet of the axial passageway to push the seal insert out of the axial passageway.

2. The spray nozzle of claim 1 wherein the axial passageway has a first cross section, and the handle is tapered and includes a second cross section that is smaller than the first cross section.

3. The spray nozzle of claim 1 wherein the turret member is movable between a spraying position and a cleaning position, and the handle includes direction indicia for indicating the position of the turret member.

4. The spray nozzle of claim 3 wherein the handle is made of soft plastic.

5. The spray nozzle of claim 3 wherein the direction indicia includes an arrow-shaped portion for pushing the seal from the axial passageway.

6. A spray nozzle comprising: a spray tip housing, a turret member, and a seal insert, the spray tip housing including a first transverse passageway and an axial passageway, the seal insert including a second transverse passageway and being operatively disposed in the axial passageway of the spray tip housing, the turret member including a cap member and a stem portion, the stem portion being operatively disposed in the first and second transverse passageways and being removable from the spray tip housing to disassemble the spray nozzle, the cap member being sized and configured to facilitate removal of the seal insert from the axial passageway of the spray tip housing.

7. The spray nozzle of claim 6 wherein the axial passageway has a rectangular cross section and the cap member has a rectangular cross section that is smaller than the cross section of the axial passageway.

8. The spray nozzle of claim 7 wherein the turret member is movable in the first and second transverse passageways between a spraying position and a cleaning position, and the cap member includes direction indicia to indicate the position of the turret member.

9. The spray nozzle of claim 6 wherein the cap member includes an arrow-shaped portion having a segment with a first rectangular cross section and a second segment with a smaller cross section, the second segment being sized to fit in the axial passageway of the spray tip housing to push the seal insert out of the axial passageway.

10. The spray nozzle of claim 8 wherein the cap member includes a tapered end that provides direction indicia and at least partially fits in the seal insert-receiving passageway.

11. A method of disassembling a spray nozzle comprising the steps of:

providing a nozzle housing having an axial passageway and a transverse passageway, a seal insert operatively disposed in the axial passageway, and a turret member having a cap member and a stem portion operatively disposed in the transverse passageway;

removing the turret member from the transverse passageway; and aligning the cap member with the seal insert and pushing against the seal insert to eject the seal insert from the transverse passageway.

12. The method of claim 11 wherein the axial passageway has a first cross section and the cap member has a second cross section smaller than the first cross section to engage the seal insert and enter the axial passageway.

13. A method of ejecting a seal from a reversible spray tip assembly wherein the seal has a concave sealing surface and a forward surface separate therefrom, the method comprising the steps of:

a. removing a turret member from a spraying position in the reversible spray tip assembly;

b. inserting a handle of the turret into the front of the remainder of the spray tip assembly; and c. ejecting the seal out the rear of the remainder of the spray tip assembly by urging the handle against the forward surface of the seal such that there is no contact with the concave sealing surface of the seal that abuts the barrel when the turret is in the spraying position.

14. The method of claim 13 wherein a handle portion of the turret has an arrow-shaped portion and the forward surface of the seal has a pair of diverging sections and step c. further comprises urging the arrow-shaped portion of the handle against the diverging sections of the forward surface of the seal.

* * * * *